US005837326A

United States Patent [19]

Dallaire et al.

[11] Patent Number: 5,837,326

[45] Date of Patent: Nov. 17, 1998

[54] THERMALLY SPRAYED TITANIUM DIBORIDE COMPOSITE COATINGS

[75] Inventors: Serge Dallaire; Henri L. Levert, both of Quebec, Canada

[73] Assignee: National Research Council of Canada, Ottawa, Canada

[21] Appl. No.: 630,445

[22] Filed: Apr. 10, 1996

[51] Int. Cl.[6] ..... C23C 4/06; C23C 4/10; C23C 4/16

[52] U.S. Cl. ..... 427/449; 427/455; 427/456; 106/1.05

[58] Field of Search ..... 427/449, 455, 427/456; 106/1.05, 1.22, 1.23

[56] References Cited

U.S. PATENT DOCUMENTS

| | | | |
|---|---|---|---|
| 3,025,182 | 3/1962 | Schrewelius | 427/449 |
| 3,332,752 | 7/1967 | Batchelor et al. | 427/449 |
| 3,440,079 | 4/1969 | Jensen | 427/449 |

OTHER PUBLICATIONS

S. Dallaire et al, Synthesis and Deposition . . . Surface and Coatings Technology (1992) 50, 241–248 (no month date).

S. Dallaire et al, Phenomenology of Reactive Core . . . Proceedings of the Intl. Thermal Spray . . . Orlando, May 28, 1992.

*Primary Examiner*—Katherine A. Bareford

*Attorney, Agent, or Firm*—Juliusz Szereszewski

[57] ABSTRACT

Abrasion-wear resistant thermal sprayed stainless steel based coatings are disclosed, particularly arc sprayed stainless steel coatings containing titanium diboride crystals which impart hardness to the soft stainless steel matrix and enhance their resistance to hard abrasive media. There is also disclosed a process for making core wires composed of stainless steel sheaths and cores composed of a mixture of titanium diboride, stainless steel and certain additives. During the thermal spraying operation, the stainless steel sheath and the core material melt to form a composite coating containing fine hard titanium boride crystals dispersed within stainless steel. The arc sprayed stainless steel based coatings are more resistant to abrasion wear than solid pieces of type 304 stainless steel and other arc-sprayed stainless steel-based coatings available on the market. Although reference is made mainly to the arc spraying process, the core wires are suitable for other thermal spraying processes that use wires as the feed material, for instance combustion and arc-plasma spraying and weld overlay surfacing techniques.

4 Claims, 2 Drawing Sheets

THERMALLY SPRAYED TITANIUM DIBORIDE COMPOSITE COATINGS

FIELD OF THE INVENTION

This invention relates to the production of abrasion wear resistant metal-based coatings containing titanium diboride crystals or particles by thermal spraying. More particularly, the invention is concerned with those spraying procedures that use wire as the feed material. The invention relates also to the production of core wires for the thermal spraying of the coatings.

BACKGROUND OF THE INVENTION.

Thermal spraying is the generic name for a class of processes that allow the deposition of molten or semi-molten materials on substrates to form thick coatings. These processes include plasma, flame, arc-plasma, arc and combustion spraying. Materials to be deposited are fed into the heat zone of the spray cone in the form of powder, rod or wire. The arc and arc-plasma spraying processes necessarily require the spray material to be in the form of wire. In arc spraying, two electrically conductive wires are melted due to the electric arc struck between their tips and the molten material is atomized by compressed gas and sprayed onto the part to be coated. This process is demanding in term of wire quality and wire feeding in order to maintain a stable arc which in turn affects the quality of the coating.

Although wires can also be sprayed by plasma, flame and combustion processes, it is more economical to use arc and arc-plasma spraying techniques for this purpose. Arc spraying, invented by Schoop in 1910, is a coating technique widely used in industry, mainly in applications involving corrosion protection and parts' salvage. It offers considerable advantages over other thermal spraying techniques. A material deposition rate of up to three times higher than with flame spraying, a 90% energy efficiency, requiring as little as 2.5 kW in comparison with 40 kW for plasma spraying, and its simplicity of operation, which does not require spray powder handling and conditioning, make it suitable for on-site operations.

Until recently, these unique advantages have been discounted by the need to use solid electrically conductive wires as the feed material, thus restricting the process to the deposition of metals such as steels, copper, nickel, zinc, aluminum and their alloys; thus limiting the range of applications.

Core wires composed of a sheath of metal filled with ceramic and metal powders ("cermet powders"), like those used in welding, have been proposed relatively recently as arc spraying material to form wear-resistant coatings. The large oxide or carbide particles dispersed within the core of nickel and steel sheathed wires were found to be unevenly distributed within the resulting coatings, some remaining unmelted or poorly bonded to the metal matrix. These attempts, described in the scientific literature, did not lead to industrial nor commercial developments.

U.S. Pat. No. 4,578,114 (European Patent 210,644) to S. Rangaswamy et al. discloses a thermal spray wire having an aluminum sheath and a core having a base constituent consisting of at least one of nickel, iron, cobalt and chromium and comprising aluminum and yttrium oxide particles. This wire is claimed to produce tenacious and corrosion resistant coatings.

In the U.S. Patent 4,019,875, Dittrich et al. describe core wires having. aluminum-coated nickel or cobalt core flame spray materials comprising as a first component, an alloy containing at least 40 wt % of nickel or cobalt and aluminum as the second component.

Dallaire et al., U.S. Pat. No. 4,673,550, propose a process for obtaining titanium boride-based composite materials. The patent describes procedures for obtaining plasma deposited coatings from agglomerated powders and dense parts by isostatically pressing reacted powders.

Dallaire et al, Synthesis and Deposition of $TiB_2$-containing Materials by Arc Spraying, Surface and Coatings Technology, 50(1992), 241–248, propose to obtain a coating of a titanium diboride ($TiB_2$) containing material by arc spraying. A core wire is used which contains, within a metal sheath, a reactive powder consisting mainly of ferrotitanium and boron. The sheath material is stainless steel and nickel. The core components react during arc spraying producing titanium diboride particles in the resulting coatings.

The same concept is further discussed in Dallaire et al., Phenomenology of Reactive Core Wire Arc Spraying, Proceedings of the International Thermal Spray Conference & Exposition, Orlando, 28 May–5 Jun. 1992. The paper reports that iron powder was added to the core components.

While the arc-spraying process described in the two latter papers is useful to obtain wear-resistant $TiB_2$-containing coatings, some technical difficulties still remain and the cost of producing the respective coatings is still substantial. Accordingly, there is a need for a controllable, effective and less expensive process for producing abrasion wear-resistant coatings containing uniformly distributed titanium diboride crystals.

SUMMARY OF THE INVENTION

It is an object of the invention to provide a thermal-spraying process for producing a composite coating comprising fine titanium diboride particles or crystals distributed throughout a metallic matrix.

It is another object of the invention to provide core wires suitable for the above-defined thermal spraying process.

In accordance with the invention, there is provided a process for producing wear-resistant thermally sprayed coatings comprising fine particles of titanium diboride distributed throughout a metallic matrix, the process comprising:

providing core wires consisting of a metallic sheath and a compacted powder core, the core comprising titanium diboride and at least one metal or metal alloy, thermally spraying said core wires onto a substrate to obtain a coating on the substrate, and allowing said coating to solidify on said substrate.

In accordance with another aspect of the invention, there is provided a composite wire for use in the above process, the core wire comprising a metallic sheath and a compacted powder core comprising titanium diboride and at least one metal or metal alloy, the metal or alloy being compatible, when thermally sprayed, with the titanium diboride.

Preferably, for the purpose of corrosion resistance, the material of the metallic sheath, as well as the material of the metallic powder of the core, is steel, for instance a stainless steel or a low-alloy steel. However, other metals and alloys are also amenable to the process of the invention as long as they are compatible upon thermal spraying with the titanium diboride powder.

Typically, titanium diboride crystals or particles distributed throughout a metal matrix of the resulting coating will afford wear resistance to the coating. It is understood, however, that certain metals have markedly higher wear resistance than others and the titanium diboride phase should be combined with selected metals for a high wear resistance, possibly combined with high corrosion resistance.

For high wear resistance coatings, the content of titanium diboride powder in the core powder may be from about 5 wt. percent to about 95 wt. percent, preferably from about 10 wt. % to about 70 wt. %.

The composite wire may comprise for instance a stainless steel sheath which encloses a core containing titanium diboride powder, stainless steel powder and other metallic or non-metallic powders, e.g. tin, graphite and other components as described in detail hereinbelow. Some of those components promote the formation of austenite, ferrite or martensite within stainless steel. Other components may promote the melting of stainless steel within the core allowing a good dispersion of the titanium diboride particles or crystals within the matrix.

DETAILED DESCRIPTION OF THE INVENTION

Figure 1:
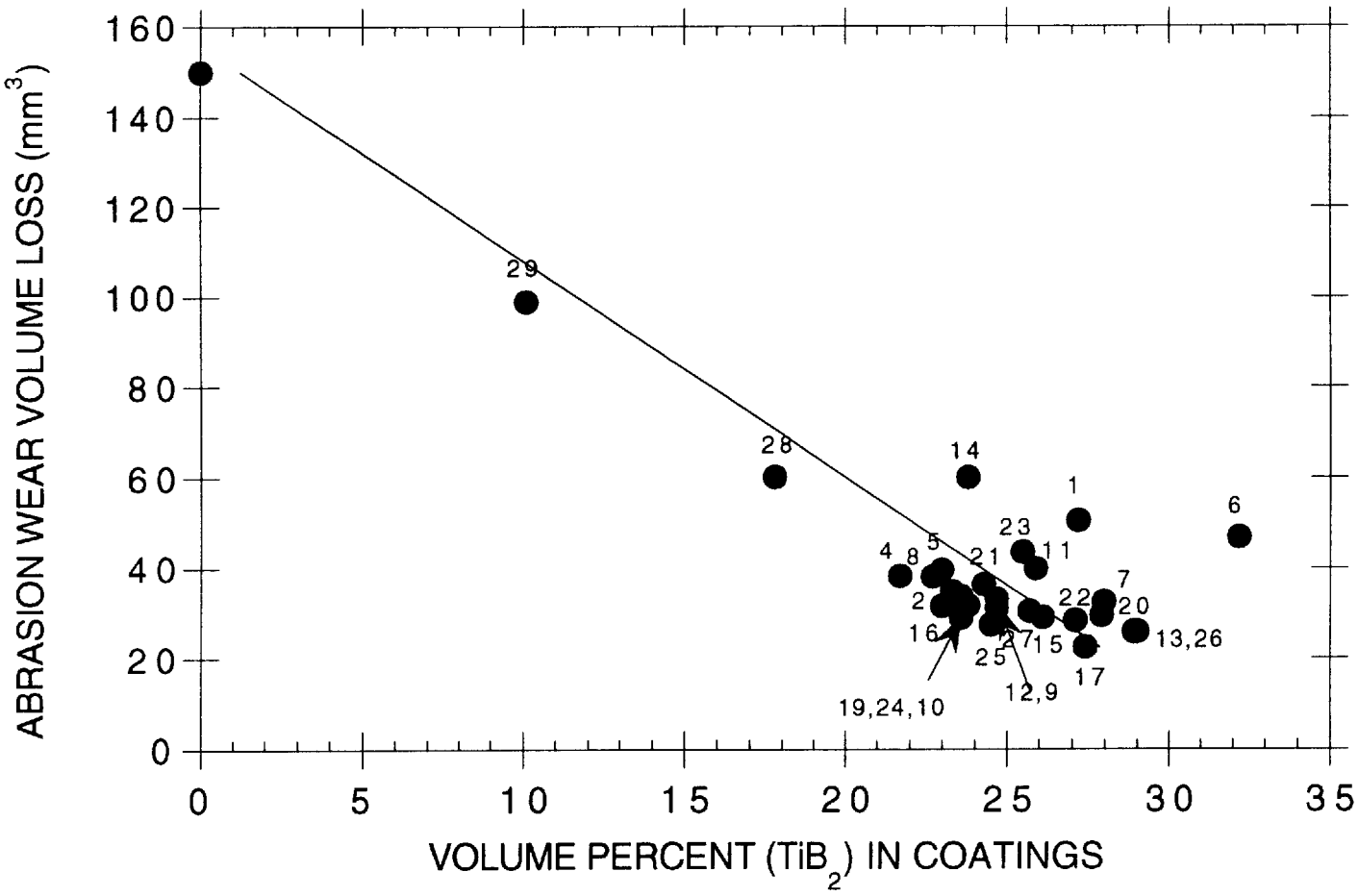
FIG. 1 is a graph illustrating wear volume loss of arc sprayed stainless steel composite coatings.

Over thirty different wire compositions were tested by evaluating wear resistance of the respective coatings obtained using the wires of the invention and a commercial electric arc system. The results are compared with those measured on solid stainless steel pieces, commercial stainless steel-based arc-sprayed coatings and those described in the aforementioned papers by Dallaire et al.

The coatings were prepared by the following general steps:

thoroughly mixing the powder or powders, forming a metal strip into a "U" shape, loading the metal strip with the core powder, cold drawing the wire to final size, producing coatings by arc spraying the wire with air onto grit blasted substrates.

A detailed exemplary procedure for fabricating cored wires, making coatings by arc spraying and evaluating the abrasion wear resistance is described below.

Preparation of the core powder material.

Stainless steel 316L powders were thoroughly mixed with titanium diboride crystals and additives in a tumbler for 16–24 hours. The composition of mixed powders and their physical characteristics is given in Table I and II. In most cases, agglomeration of powders is not required provided that the suitable particle size distribution is chosen.

Wire fabrication

The sheath of the wire, made of a strip of type 304 stainless steel, measuring 0.005 inch thick by 0.400 inch wide, was drawn in a continuous manner through a series of standard wire drawing dies aligned in a descending order of diameter of orifices. At a stage where the strip took the form of a "U" shape, the mixed powders described in Table I and II were filled into the strip which was than closed in such a way that the edges of the strip formed an overlapping joint mandatory to achieve good powder compacting during the subsequent standard wire drawing operations required to draw the wire to a final diameter of 1.60 mm.

Depending of the powder mixes and the cored wire loading, coatings containing up to 35 vol. % of titanium boride were produced.

Arc spraying experiments

Arc spraying experiments were carried out with the above- described wires using a commercial Miller BP 400 Arc Spray System under ambient atmosphere. Coatings can be obtained by spraying with different gases as the atomizing gases. Air was preferred because of its availability and low cost. For all experiments, the voltage was set at a level adequate to obtain a stable arc spraying operation. The amperage was regulated at around 150 amps. The spraying distance was set at 6½ inches for most of the experiments.

Table I summarises the properties of the exemplary components of the core wires of the invention. Two different types of titanium diboride powder and three different types of stainless steel powders were used. Those particular types are indicated in brackets in the corresponding columns of Table II.

TABLE I

Composition and particle size distribution of the main constituents

Stainless Steel AISI 316L Chemical Composition

| Element | Stainless Steel powder #1 (wt %) | Stainless Steel powder #2 (wt %) | Stainless Steel powder #3 (wt %) |
|---|---|---|---|
| Chromium | 17.65 | 16.89 | 17.0 |
| Nickel | 11.67 | 11.06 | 11.3 |
| Molybdenum | 2.32 | 2.08 | 2.2 |
| Silicon | 0.98 | 0.76 | 0.52 |
| Manganese | 0.16 | 0.11 | 1.48 |
| Carbon | 0.018 | 0.018 | 0.032 |
| Sulfur | 0.016 | 0.010 | 0.08 |
| Phosphorus | 0.010 | — | 0.02 |
| Iron | Balance | Balance | Balance |

Stainless Steel AISI 316L Particle Size

| TYLER MESH | Stainless Steel powder #1 (wt %) | Stainless Steel powder #2 (wt %) | Stainless Steel powder #3 (wt %) |
|---|---|---|---|
| +100 | 3.4 | 1.6 | — |
| +150 | 15.0 | 9.8 | — |
| +200 | 30.8 | 14.7 | — |
| +325 | 64.4 | 28.1 | — |
| −325 | 35.6 | 45.8 | — |
| −625 | — | — | 100.0 |

Titanium Diboride Powder Chemical Analysis

| Element | Titanium diboride powder #1 (wt %) | Titanium diboride powder #2 (wt %) |
|---|---|---|
| Titanium | 67–69 | 67–69 |
| Boron | 29–32 | 29–32 |
| Carbop (max.) | 0.25 | 0.50 |
| Oxygen (max.) | 0.50 | 0.50 |
| Nitrogen (max.) | 0.15 | 0.15 |

Trace metals: Fe: 0.02%, Zr: 0.015%

Titanium Diboride Powder —Physical Properties

Mean particle size: 10 +/−2 $\mu$m Surface area: 0.25 $m^2/g$

Figure 2:
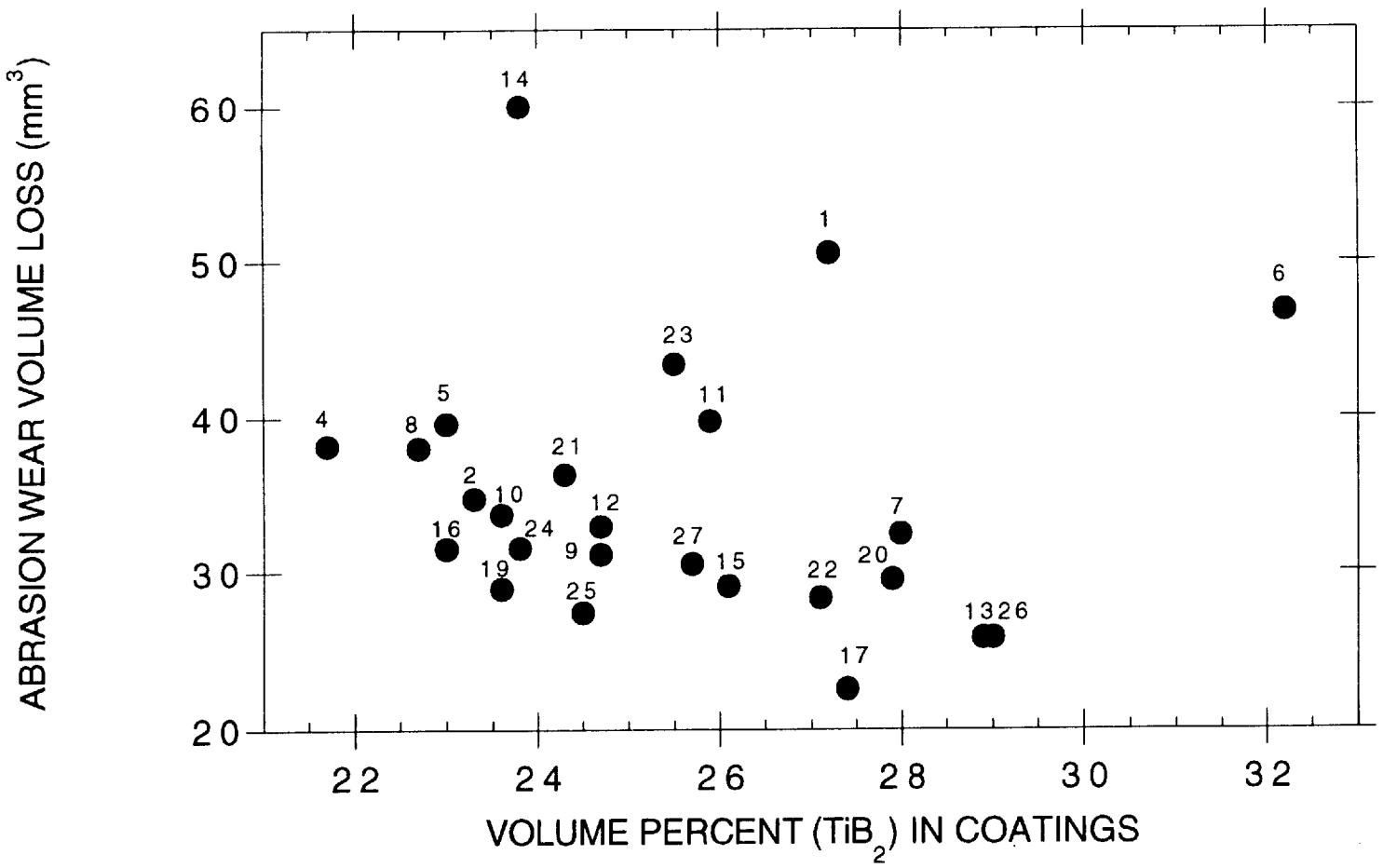
FIG. 2 represents a magnified portion of the graph of FIG. 1.

Table II displays the results of the experiments conducted to validate the invention, the results being also graphically represented in FIG. 1 and FIG. 2 (a magnified portion of FIG. 1).

TABLE II

| Sample Ident. | Core Wt % $TiB_2$ | Core Wt % S.S. 316L | Core Addition Wt % Element | Volume loss (mm3) |
|---|---|---|---|---|
| | CORE POWDER COMPOSITION AND ABRASION WEAR VOLUME LOSS | | | |
| 29 | 10(2) | 84(2) | 4 W, 2 Mn | 98.99 |
| 3 | 40(1) | 50(3) | 10 Al, | 75.40 |
| 28 | 19(2) | 72(2) +325M | 4 Sn, 5 W | 60.18 |
| 14 | 34(1) | 64(1) | 2 C | 60.03 |
| 18 | 33(1) | 61(3) | 6 Sn | 53.90 |
| 1 | 35(1) | 36(1), 24(3) | 5 Al | 50.54 |
| 6 | 50(1) | 42(1) −325 Mesh | 8 Al | 46.82 |
| 23 | 34.6(2) | 52.6(2) | 12.8 Sn | 43.45 |
| 11 | 33(1) | 61(1) | 6 $ZrSi_2$ | 39.78 |
| 5 | 30 | 60(1) −325 Mesh | 5 Al | 39.60 |
| 4 | 30 | 65(1) −325 Mesh | 5 $TiAl_3$ | 38.19 |
| 8 | 35(1) | 65(1) −325 Mesh | — | 38.05 |
| 21 | 29.75(2) | 55.25(2) | 15 Sn | 36.31 |
| 2 | 30(1) | 60(3) | 5 Al, 5 CrB | 34.74 |
| 10 | 33(1) | 61(1) | 6 $MgB_2$ | 33.69 |
| 12 | 33(1) | 61(1) | 6 Si | 32.94 |
| 7 | 65(1) | 35(1) −325 Mesh | — | 32.44 |
| 16 | 34(1) | 58(1) | 4 Sn, 4 CrB | 31.49 |
| 24 | 32(2) | 53(2) | 12 Sn, 3 Ti | 31.55 |
| 9 | 34(1) | 63(1) −325 Mesh | 3 $MgB_2$ | 31.10 |
| 27 | 38(2) | 49(2) | 7 Sn, 4 Ti, 2 B | 30.49 |
| 20 | 33(2) | 55(2) | 12 CuSn (50% Cu) | 29.50 |
| 15 | 34(1) | 58(1) | 6 Sn, 2 Si | 29.09 |
| 19 | 33(2) | 61(1) −270 Mesh | 6 Sn | 28.91 |
| 22 | 32.79(2) | 57.68(2) | 9.53 Sn | 28.32 |
| 25 | 38(2) | 49(2) | 10 Sn, 3 Ti | 27.40 |
| 26 | 38(2) | 49(2) | 10 Sn, 2 Ti, 1 B | 25.80 |
| 13 | 33(1) | 61(1) | 6 Sn | 25.80 |
| 17 | 33(1) | 55(1) | 12 Sn | 22.50 |

Wear resistance

Wear tests were carried out on arc sprayed coatings which had previously been ground flat according to the Dry Sand/Rubber Wheel Test, ASTM G-65, procedure B. The coating volume loss was obtained by measuring the volume of the cavity formed by the wearing process using an optical profilometer with an accuracy of 1%.

It is generally accepted that the abrasion wear resistance of composite materials, e.g. metallic materials containing ceramic particles, depends on the volume fraction of hard particles within the composite materials. The higher the volume fraction of hard particles, the lower the volume loss due to abrasion. The volume loss due to abrasion of arc sprayed stainless steel containing different volume fraction of hard titanium diboride particles decreases as the volume fraction increases as shown in FIG. 1. The wear volume (W) can be represented by the following equation:

$$W=155-473f_2$$

where $f_2$ designates the volume fraction of titanium diboride within coatings.

Though this general trend seems to apply, it stands to reason that the volume fraction of hard particles within the coatings is not the only variable that should be considered to explain the behaviour of arc sprayed stainless steel-titanium diboride coatings. If volume losses lower than 60 $mm^3$ are considered with regards to the volume fraction of hard particles, as shown in FIG. 2, it could be observed that the volume fraction of hard particles within coatings is not the only variable that could explain the decreases in wear volume losses. Indeed the coating designated as #14 had wear loss twice the volume of the coating designated as #24, though they both contain the same volume fraction of titanium diboride crystals. The wear loss of the coating designated as #1 was also twice the volume of the coating #17, though they contain the same volume fraction of titanium diboride crystals. On the other hand, coatings #16 and #7 roughly experienced the same wear volume loss, though coating #7 contains much more titanium diboride crystals.

Therefore, it appears that the volume loss of these stainless steel-titanium diboride coatings follows a rule different from the general rule of mixing. This rule should account for addition elements that modify the behaviour of coatings.

Most likely, the volume loss of coatings submitted to abrasion could be expressed by the inverse rule of mixing defined by the following equation:

$$1/W=f_1/W_1+f_2/W2$$

where W is the volume loss of a coating containing a volume fraction $f_1$ of a first component which loses a volume $W_1$ and a volume fraction $f_2$ of a second component which loses a volume $W_2$.

In the actual tests, $W_1$ and $f_1$, are the volume loss and the volume fraction, respectively, of stainless steel within coatings; $W_2$ is the volume loss corresponding to the core of the wire of the invention, containing titanium diboride, while $f_2$ is the respective volume fraction. The volume loss $W_2$ takes into account the purity and particle sizes of the main constituents of the core as well as the additives.

The values of the calculated volume loss corresponding to the core ($W_2$) appear in Table III with regard to the total volume loss and the titanium diboride volume content of core wires. As shown in the Table III, some cores present very good wear characteristics. In addition to the titanium diboride volume content of coatings, these $W_2$ values are useful to illustrate the influence of components on the wear performance of coatings. This is shown in Table IV which summarises the core materials and the performance of respective coatings. Generally, stainless steel-titanium diboride coatings contain 10 to 30 vol. % $TiB_2$ and 90 to 70 vol. % stainless steel. The abrasion volume loss is between 98.99 and 22.5 $mm^3$. The percentage of $TiB_2$ within the core, the chemical composition of each constituent as well as the particle size have a marked influence on the abrasion volume loss.

Influence of titanium diboride content

Even though most of the coatings presented wear characteristics better than stainless steel, it should be pointed out that below a titanium diboride core content of 10 wt %, little improvement in abrasion wear is observed.

A core constituted of only stainless steel and titanium diboride powders results in wear resistant coatings with titanium diboride content up to 95 wt %. However, there is hardly any difference in wear resistance between coatings where the respective content of titanium diboride in the core is 35 wt % compared to 65% $TiB_2$ in the core (conf. samples no. 7 and 8).

Influence of additives

Depending of the types of stainless steel and titanium diboride crystals, additional components are beneficial for the wear resistance. Tin alone (below a certain extent) or with other elements or compounds is particularly attractive. In combination with titanium diboride powder, tin markedly increases the wear resistance of the respective coatings as compared with cores containing no tin. For instance, coatings no. 13 and 17 exhibit better properties than coating no. 8.

The addition of 2 wt. % graphite increases the volume loss of coatings as opposed to coatings containing the same percentage of titanium diboride within the core. Consequently, the content of graphite within the core should be below 0.5 wt. %.

Aluminum (below a certain limit), $ZrSi_2$ and $TiAl_3$ present in the core produces do not appear to affect the wear performance of the respective coatings as compared with coatings containing no addition element or compound.

The addition of titanium and also boron to tin within cores containing the second type of titanium diboride crystals (#2, with higher carbon content) appears beneficial in that these additives reduce the higher carbon content of titanium diboride #2.

Chromium, vanadium, titanium, molybdenum, tantalum, niobium, tungsten, silicon and germanium are considered as alpha gene elements. They favor the formation of ferrite within an alloyed steel.

Nickel, copper, cobalt, lead and manganese are gamma gene elements. They favor the formation of austenite within an alloyed steel.

Addition elements or compounds should be as pure as possible and should contain very little oxygen. The particle size of these addition elements should be below 45 micrometers.

Influence of stainless steel powders

The use of either type of stainless steel powders does not seem to be a limitation. Good performances were obtained with different compositions and particle sizes. A coarse stainless steel powder (containing particles with a diameter 4.5 to 15 times the nominal diameter of the titanium diboride particles) is however preferable.

TABLE III

THE INFLUENCE OF THE VOLUME LOSS CORRESPONDING TO THE CORE OF THE WIRE AND $TIB_2$ VOLUME PERCENT WITHIN COATINGS ON THE VOLUME LOSS OF ARC SPRAYED COATINGS

| Sample ident. | $TiB_2$ volume % in coatings | Coating volume loss ($mm^3$) | Volume loss corresp. to the core of the wire ($mm^3$) |
|---|---|---|---|
| 1 | 27.2 | 50.54 | 18.21 |
| 2 | 23.3 | 34.74 | 9.84 |
| 4 | 21.7 | 38.19 | 10.35 |
| 5 | 23.0 | 39.60 | 11.43 |
| 6 | 32.2 | 46.82 | 19.12 |
| 7 | 28.0 | 32.44 | 10.75 |
| 8 | 22.7 | 38.05 | 10.74 |
| 9 | 24.7 | 31.10 | 9.10 |
| 10 | 23.6 | 33.69 | 9.60 |
| 11 | 25.9 | 39.78 | 12.82 |
| 12 | 24.7 | 32.94 | 9.75 |
| 13 | 29.0 | 25.80 | 8.52 |
| 14 | 23.8 | 60.03 | 20.56 |
| 15 | 26.1 | 29.09 | 8.86 |
| 16 | 23.0 | 31.49 | 8.64 |
| 17 | 27.4 | 22.50 | 6.92 |
| 19 | 23.6 | 28.91 | 8.00 |
| 20 | 27.9 | 29.50 | 9.59 |
| 21 | 24.3 | 36.31 | 10.80 |
| 22 | 27.1 | 28.32 | 8.90 |
| 23 | 25.5 | 43.45 | 14.13 |
| 24 | 23.8 | 31.55 | 8.94 |
| 25 | 24.5 | 27.40 | 7.79 |
| 26 | 28.9 | 25.80 | 8.50 |
| 27 | 25.7 | 30.49 | 9.23 |
| 28 | 17.8 | 60.18 | 15.98 |
| 29 | 10.1 | 98.99 | 24.58 |

TABLE IV

CLASSIFICATION OF COATING WEAR WITH THEIR $TIB_2$ VOLUME CONTENT, VOLUME LOSS CORRESPONDING TO THEIR CORE, TYPE OF MATERIALS AND ADDITION WITHIN THE CORE

| Volume loss corresp. to the core of the wire ($mm^3$) | Coating Sample | Coating wear: Volume loss ($mm^3$) | Addition elements in the core (wt %) | $TiB_2$ within the core (wt %) | Type of stainless steel and titanium diboride powders within the core |
|---|---|---|---|---|---|
| 6.9–8.0 | 17 | 22.50 | 12 Sn | 33 | SS1, TD1 |
| | 25 | 27.40 | 10 Sn, 3 Ti | 38 | SS2, TD2 |
| | 19 | 28.91 | 6 Sn | 33 | SS1(−270 m), TD1 |

TABLE IV-continued

CLASSIFICATION OF COATING WEAR WITH THEIR $TiB_2$ VOLUME CONTENT, VOLUME LOSS CORRESPONDING TO THEIR CORE, TYPE OF MATERIALS AND ADDITION WITHIN THE CORE

| Volume loss corresp. to the core of the wire ($mm^3$) | Coating Sample | Coating wear: Volume loss ($mm^3$) | Addition elements in the core (wt %) | $TiB_2$ within the core (wt %) | Type of stainless steel and titanium diboride powders within the core |
|---|---|---|---|---|---|
| 8.5–8.7 | 13 | 25.80 | 6 Sn | 33 | SS1, TD1 |
| | 16 | 31.49 | 4 Sn, 4 Cr B | 34 | SS1, TD1 |
| | 26 | 25.80 | 10 Sn, 2 | 38 | SS2, TD2 |
| 8.8–8.9 | 15 | 29.09 | 6 Sn, 2 Si | 34 | SS1, TD1 |
| | 22 | 28.32 | 9.53 Sn | 32.79 | SS2, TD2 |
| | 24 | 31.55 | 12 Sn, 3 Ti | 32 | SS2, TD2 |
| 9.1–9.2 | 9 | 31.10 | 3 $MgB_2$ | 34 | SS1(−325M), TD1 |
| | 27 | 30.49 | 7 Sn, 4 Ti, 2B | 38 | SS2, TD2 |
| 9.6 | 10 | 33.69 | 6 $MgB_2$ | 33 | SS1, TD1 |
| | 20 | 29.50 | 12 CuSn | 33 | SS2, TD2 |
| 9.75–9.85 | 2 | 34.74 | 5 Al, 5 Cr B | 30 | SS3, TD1 |
| | 12 | 32.94 | 6 Si | 33 | SS1, TD1 |
| 10.4 | 4 | 38.19 | 5 $TiAl_3$ | 30 | SS1(−325M), TD1 |
| 10.7–10.8 | 7 | 32.44 | — | 65 | SS1(−325M), TD1 |
| | 8 | 38.05 | — | 35 | SS1(−325M), TD1 |
| | 21 | 36.31 | 15 Sn | 29.75 | SS2, TD2 |
| 11.4–12.8 | 5 | 39.60 | 5 Al | 30 | SS1(−32.5M), TD1 |
| | 11 | 39.78 | 6 $ZrSi_2$ | 33 | SS1, TD1 |
| 14 | 23 | 43.45 | 12.8 Sn | 34.6 | SS2, TD2 |
| 16 | 28 | 60.18 | 4 Sn, 5 W | 19 | SS2(+325M), TD2 |
| 18–19 | 1 | 50.54 | 5 Al | 35 | 36% SS1, 24% SS3, |
| | 6 | 46.82 | 8 Al | 50 | SS1(−325M), TD1 |
| 20.6 | 14 | 60.03 | 2 C | 34 | SS1, TD1 |
| 24.6 | 29 | 98.99 | 4 W, 2 Mn | 10 | SS2, TD2 |

Tables V compares the results obtained from the wires described in this invention with those measured on coatings and solid pieces of type 304 and 316 stainless steel and with arc sprayed coatings done with commercial wires.

TABLE V

DRY SAND/RUBBER WHEEL ABRASION TEST RESULTS FOR ARC SPRAYED COMMERCIAL WIRES AND ARC SPRAYED COATING OF THIS INVENTION

| Material | Volume loss ($mm^3$) |
|---|---|
| Bulk stainless steel 304–316* | 155 |
| Arc sprayed stainless steel 316* coatings | 145 |
| Arc sprayed Armacor 16* | 122.8 |
| Arc sprayed 440C* | 91.9 |
| Arc sprayed Duocor* | 78 |
| Arc sprayed 97T* | 70.6 |
| Arc sprayed Armacor M* | 64.3 |
| Arc sprayed Tufton 500* | 63.5 |
| Arc sprayed Colmonoy 88* | 62.7 |
| Arc sprayed 95MXC Ultrahard* | 62.4 |
| Arc sprayed stainless steel - $TiB_2$ coating (Dallaire et al. Journal of Thermal Spray Technology 4(2) 1995, 163–168) | 35–65 |
| Arc sprayed core wire #17 of this invention | 22.5 |

Colmonoy 88 is the Wall Colmonoy Corporation trademark of a core wire based on a nickel alloy containing 0.8% C, 4.0% Si, 15.0% Cr,, 3.5% Fe, 3.0% B and 17.3% W.

Armacor 16, Armacor M and Duocor are the Amorphous Technologies International trademarks of iron-based core wires.

Armacor M contains 1.4% Si, 28.5% Cr, 4.9% Ni, 2.5% Mn, 3.5% B.

Armacor 16 contains 8.4% Cu, 1.8% Si, 21.0% Cr, 6.5% Ni, 1.0% Mn, 2.5% B, 0.2% max. C.

Duocor contains 1.2% Si, 14.0% Cr, 4.5% Ni, 0.6% Mn, 1.9% B, 26.0% WC, 6.0% TiC.

95MXC Ultrahard is the Hobart Tafa Technologies trademark of a proprietary high chrome steel alloy core wire.

97T is the Metallisation Limited trademark of a steel-based core wire containing tungsten carbide.

Tufton 500 is the Mogul-Miller Thermal Inc. trademark of steel wire containing 1.9% Mn, 1.1% $O_2$ and 2.5% elements not specified.

440C is a martensitic stainless steel.

316 stainless steel coatings were obtained by arc spraying:

Stainless steel #1 wire of Mogul-Miller Thermal Inc. the composition of this wire is: 0.1% C, 18–20% Cr, 8–12% Ni, 2.0% Mn, 0.7–1.0% Si, Fe balance.

Stainless steel wire -85T of Hobart Tafa of which composition is: 0.08% C, 0.04% P, 0.03% S, 2.0% Mn, 12.0% Ni, 17.0% Cr, 1.0% Si, 2.5% Mo, Fe ba It has been found that the coatings obtained using the process and wires of the invention exhibit noticeably better properties than the coatings obtained by thermal spraying of wires having cores comprising ferrotitanium and boron (reactive powders). The respective values tested were 22.5 $mm^3$ compared to 26 $mm^3$. However, the deciding advantage of the present invention comparing to the above-mentioned reactive powder alternative is the relative simplicity of preparation of the core powder mixtures and filling the sheath, as well as a significantly lower cost of the core materials of the present invention.

We claim:

1. A process for producing a wear resistant coating an a metallic substrate, the coating when arc-sprayed having a volume loss, as measured by Dry Sand/Rubber Wheel Test, ASTM G-65, Procedure B, of not more than 98.99 $mm^3$, said process comprising the steps of:

providing a composite wire having a steel sheath and a compacted powder core, said core comprising itanium diboride powder in the amount from 10 wt. % to 65 wt. % and a steel powder in an amount from 35 wt. % to 84 wt. %, and thermally spraying said wire onto said substrate.

2. The process according to claim 1 wherein said steel powder is stainless steel powder.

3. A composite wire for producing a wear resistant coating on a metallic substrate by thermals spraying, the volume loss of the coating, when arc sprayed, being not more than 98.99 $mm^3$ as measured by Dry Sand/Rubber Wheel Test, ASTM G-65, Procedure B, said wire comprising:

a steel sheath, and a compacted powder core which comprises titanium diboride in an amount from 10 wt. % to 65 wt. % and a steel powder in an amount from 35 wt. % to 84 wt. %.

4. The wire of claim 3 further containing in said core at least one additive selected from the group consisting of tin, aluminum, chromium, vanadium, titanium, molybdenum, tantalum, niobium, tungsten, silicon, germanium, nickel, copper, cobalt, lead and mangancse.

* * * * *